US007201528B1

(12) United States Patent
Swegart

(10) Patent No.: US 7,201,528 B1
(45) Date of Patent: Apr. 10, 2007

(54) NOTEBOOK COVER ASSEMBLY WITH ERGONOMIC SUPPORT

(75) Inventor: Lance Swegart, 4471 Ventura Canyon Blvd. Apt D 202, Sherman Oaks, CA (US) 91423

(73) Assignee: Lance Swegart, Valley Village, CA (US)

( * ) Notice: Subject to any disclaimer, the term of this patent is extended or adjusted under 35 U.S.C. 154(b) by 455 days.

(21) Appl. No.: 10/675,267

(22) Filed: Sep. 30, 2003

(51) Int. Cl.
*B42F 13/00* (2006.01)

(52) U.S. Cl. ..... 402/73; 211/45; 281/29; 434/317; D19/26; 248/441.1

(58) Field of Classification Search ..... 402/57, 402/73, 80 R, 500, 502; 248/441.1, 444; 211/45; 281/15.1, 29; D19/26, 27; 434/317
See application file for complete search history.

(56) References Cited

U.S. PATENT DOCUMENTS

| | | | | |
|---|---|---|---|---|
| 3,043,047 | A * | 7/1962 | La Fleur | 248/454 |
| 3,776,389 | A * | 12/1973 | Waldecker | 211/90.01 |
| 5,639,123 | A | 6/1997 | Medley et al. | |
| 5,823,574 | A | 10/1998 | Sullins et al. | |
| 6,213,669 | B1 | 4/2001 | Yamamoto | |
| 6,865,367 | B2 * | 3/2005 | Kim et al. | 434/317 |

* cited by examiner

*Primary Examiner*—Monica Carter

(57) ABSTRACT

A notebook cover assembly with ergonomic support for providing ergonomic support to the wrist of a user. The notebook cover assembly with ergonomic support includes a cover member having a first portion pivotally coupled to a second portion, and designed for receiving a notebook; and a wrist support member operationally coupled to the cover member for providing support for a wrist of a user writing on the notebook.

16 Claims, 3 Drawing Sheets

NOTEBOOK COVER ASSEMBLY WITH ERGONOMIC SUPPORT

BACKGROUND OF THE INVENTION

1. Field of the Invention

The present invention relates to notepad holders and more particularly pertains to a new notebook cover assembly with ergonomic support for providing ergonomic support to the wrist of a user.

2. Description of the Prior Art

The use of notepad holders is known in the prior art. Illustrative examples include U.S. Pat. No. 5,823,574; U.S. Pat. No. 5,639,123; and U.S. Pat. No. 6,213,669.

While these devices fulfill their respective, particular objectives and requirements, the need remains for a device which can be used with a variety of conventional notebooks while providing proper ergonomic support to the user.

SUMMARY OF THE INVENTION

Although computers and personal digital assistants (PDAs) have automated many jobs and functions in virtually all areas of business and commerce, notebooks and ringed binders are still essential items which are used for a wide variety or purposes. They are universally used by students, teachers, bookkeepers, accountants and many other individuals, for many applications. They are basic tools of the trades for accountants and bookkeepers and are indispensable for inventory control and record keeping. Anyone that uses ringed binders is acquainted with some of the problems associated with ringed binders, one of the major problems being the discomfort that can be experienced when writing on the notebook pages, especially when writing for an extended period of time. The subject of this report, the notebook cover assembly with ergonomic support, is an invention/product designed to contain a ring binder or spiral notebook and afford comfort for the user when writing in the notebook.

The notebook cover assembly with ergonomic support would be rectangular, two sectioned folder that would have overall dimensions of 13 in inches in height, 18 inches in width, and 1 ½ inches in depth. The basic version of the notebook cover assembly with ergonomic support would be produced from plastic materials and versions made from other materials, including leather, would also be made available. The interior of the left and right side panels affords a slotted insert in which the cover of a ring binder or spiral notebook would be inserted to keep the notebook securely contained. The lower edge of the left and right panel, on the interior side, is fitted with a padded area that is horizontally positioned on a desk or table top when writing the area where discomfort is normally experienced. The assembly may also include top load slots for accommodating other varieties of pad, such as legal pads. By providing a notebook holder which is long enough to afford a padded area for the forearms, the discomfort felt when writing in a notebook would no longer be experienced. In addition to this most advantageous feature, the Notebook cover assembly with ergonomic support also provides a convenient, pullout drawer which is positioned beneath each padded arm support. Each drawer pulls outward from the exterior side and would provide space and easy access for pens and pencils. The advantages afforded by the Notebook cover assembly with ergonomic support would make this product quite appealing to anyone that uses spiral notebooks or ring binders, a category that includes a major part of the consumer populace.

To this end, the present invention generally comprises a cover member having a first portion pivotally coupled to a second portion, and designed for receiving a notebook; and a wrist support member operationally coupled to the cover member for providing support for a wrist of a user writing on the notebook.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
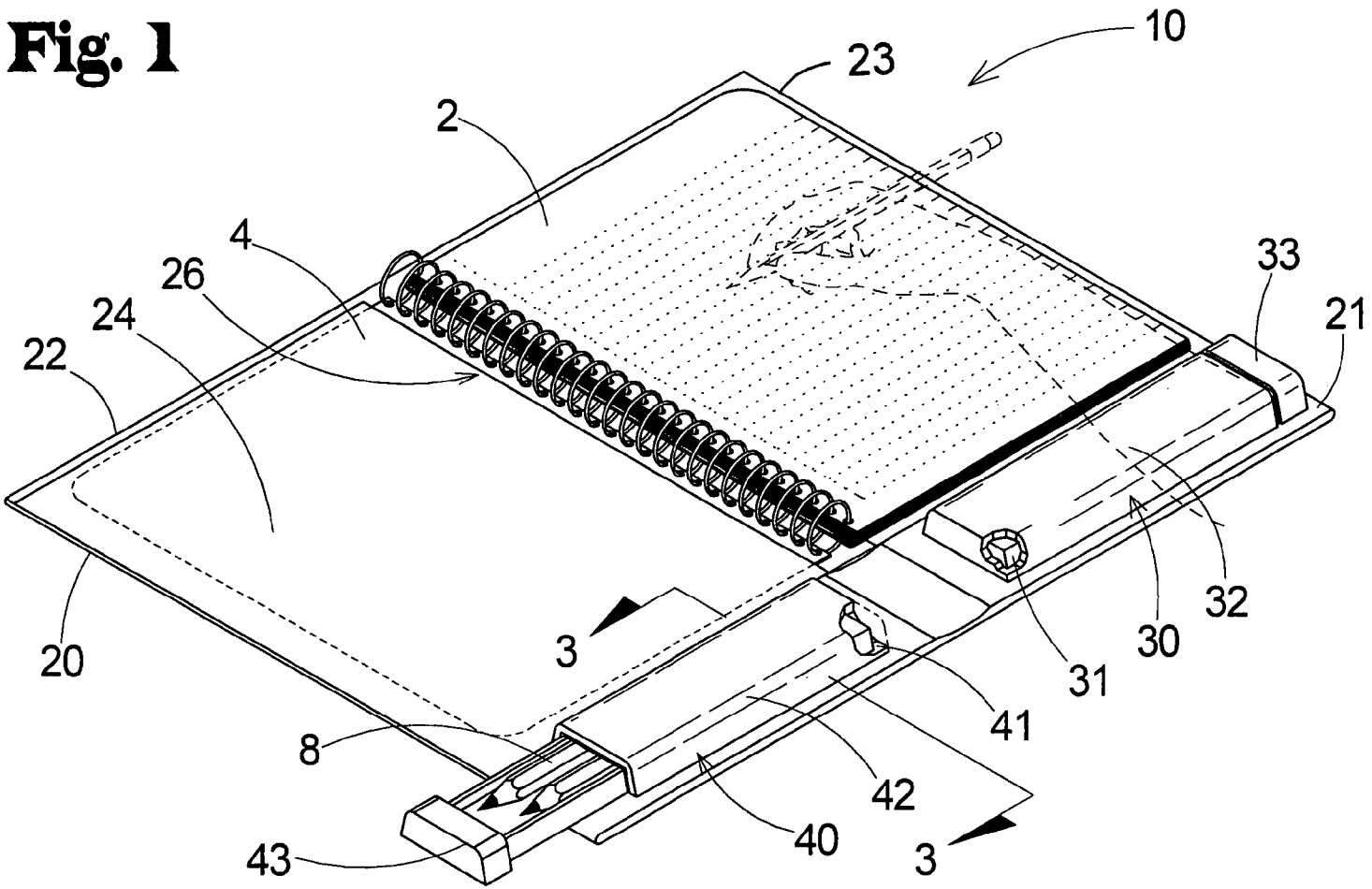
FIG. 1 is a schematic perspective view of a new notebook cover assembly with ergonomic support in use according to the present invention.
Figure 2:
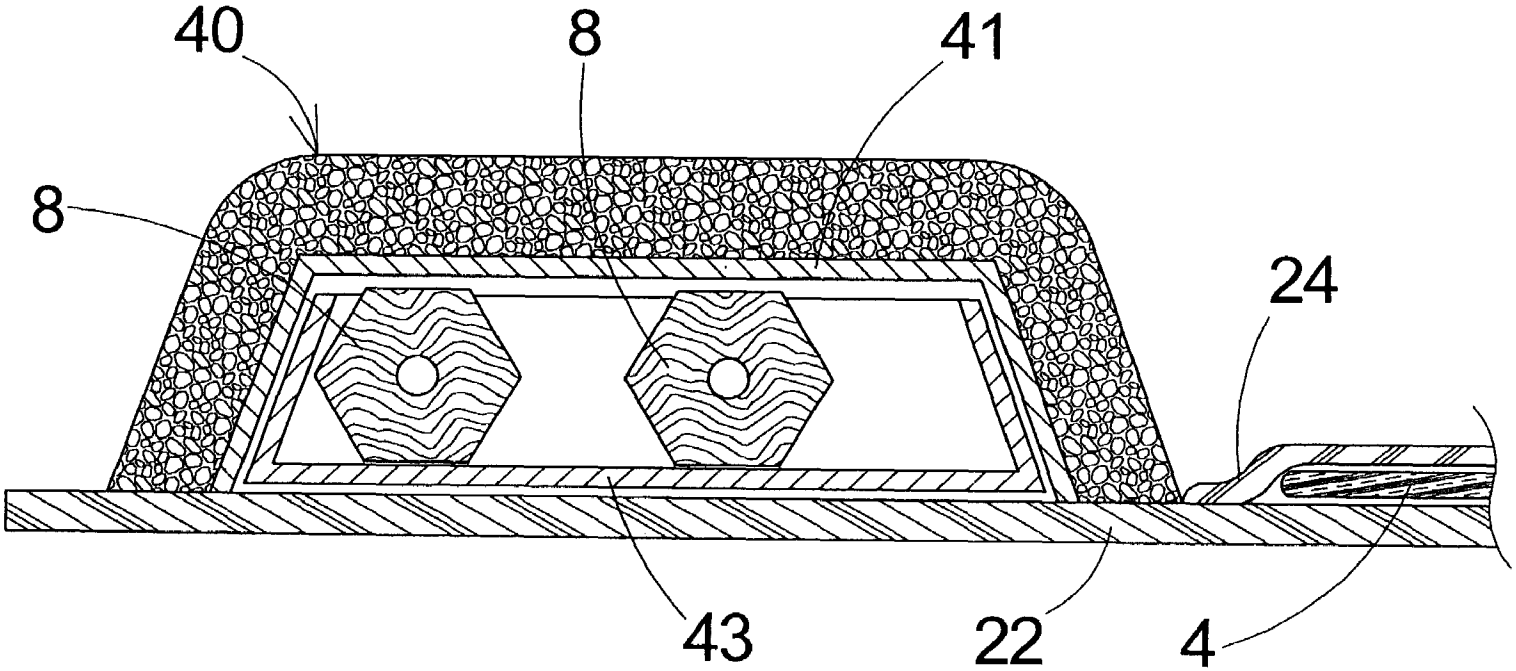
FIG. 2 is a schematic cross-sectional view of the wrist support member of the present invention.
Figure 3:
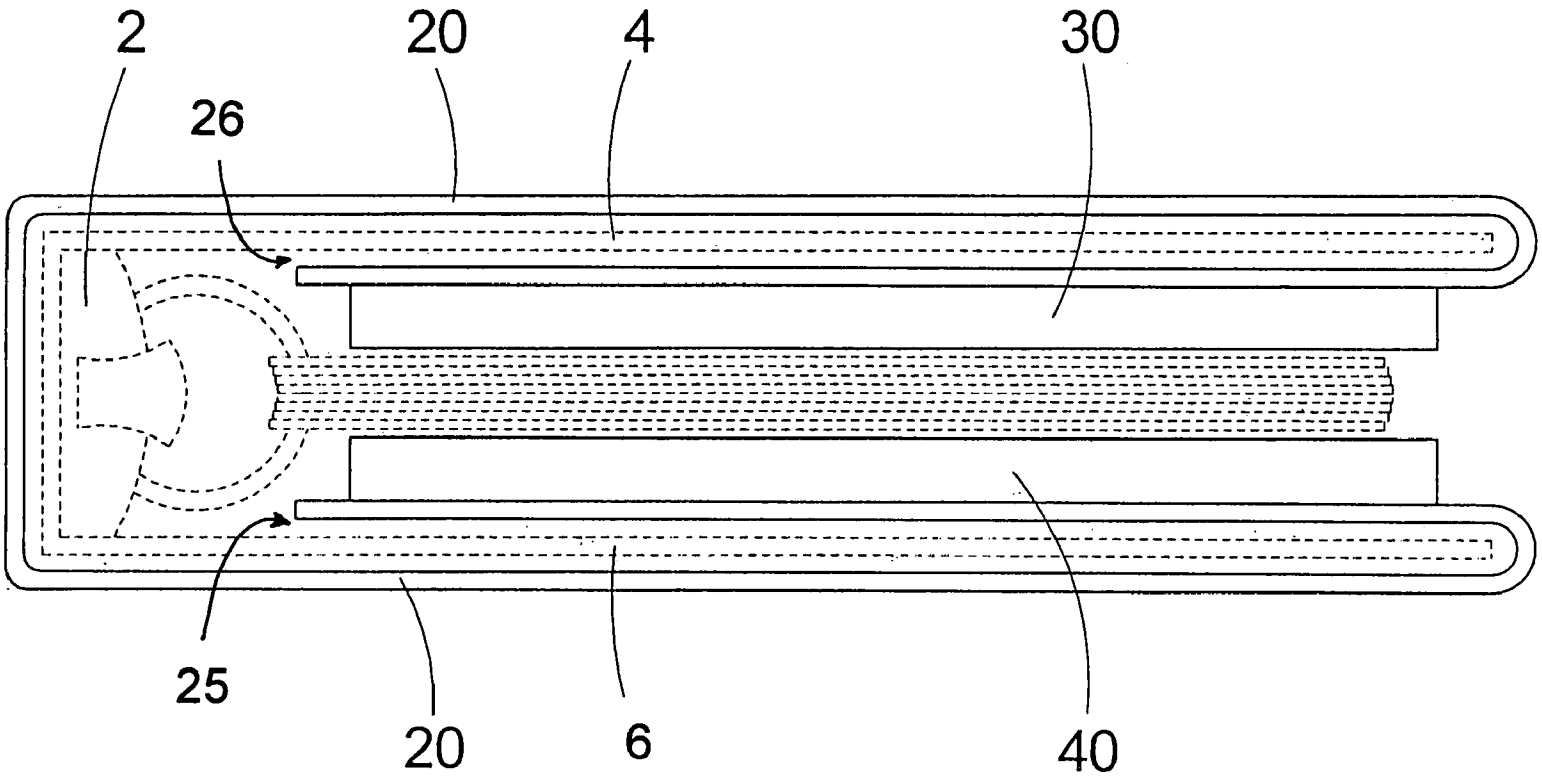
FIG. 3 is a schematic top view of the present invention in a closed position retaining a ringed binder.

With reference now to the drawings, and in particular to FIGS. 1 through 3 thereof, a new notebook cover assembly with ergonomic support embodying the principles and concepts of the present invention and generally designated by the reference numeral 10 will be described.

As best illustrated in FIGS. 1 through 3, the notebook cover assembly with ergonomic support 10 generally comprises a cover member 20, and a wrist support member 30.

The cover member 20 has a first portion 21 and a second portion 22. The first portion 21 is preferably pivotally coupled to the second portion 22 so that the cover member 20 may fold to a closed position substantially enclosing a notebook 2, or may be opened to allow access to the pages of the notebook 2. The cover member 20 is designed for receiving the notebook 2. The term notebook 2 is used as a notepad holders, which may include, but certainly is not limited to spiral bound notebooks, side bound notebooks, legal pads, ringed binders, journals, and diaries.

Preferably, the cover member 20 further comprises a first sleeve member 23 coupled to the first portion 21 of the cover member 20. The first sleeve member 23 and the first portion 21 of the cover member 20 form a pocket 25 for selectively receiving a cover 4 of the notebook 2. Thus, the notebook 2 is retained in the notebook cover assembly 10.

Even more preferably, the cover member 20 further comprises a second sleeve member 24 coupled to the second portion 22 of the cover member 20. The second sleeve member 24 and the second portion 22 of the cover member 20 form a second pocket 26 for selectively receiving a second cover 6 of the notebook 2. Thus, the notebook 2 is retained in the notebook cover assembly 10. While this example illustrates a single notebook 2 being retained by both covers 4,6 being received in associated pockets 25,26, the present invention 10 allows for retaining more than one notebook 2. As an illustrative example, a first notebook 2 may be retained by having a cover 4 inserted into the pocket 25, while a second notebook 2 is also retained by having one of its covers 6 inserted in the second pocket 26.

The wrist support member 30 is operationally coupled to the cover member 20. The wrist support member 30 provides support for a wrist of a user writing on the notebook 2. Preferably the wrist support member 30 is positioned below the pocket 25. Thus, the wrist support member 30 abuts a bottom edge of the notebook 2 retained by the pocket 20.

An embodiment includes a second wrist support member 40 operationally coupled to the cover member 20. The second wrist support member 40 provides support for a wrist of a user writing on the notebook 2, and is preferably positioned below the second pocket 26. Thus, the second wrist support member 40 abuts a bottom edge of the notebook 2 retained by the second pocket 26.

In a further embodiment the wrist support member 30 further comprises an outer housing 31, a cushion portion 32, and a drawer member 33. The outer housing 31 is designed for supporting a wrist of a user writing in the notebook 2. The outer housing 31 may be substantially hollow, and include an open end. The cushion portion 32 is operationally coupled to an exterior of the outer housing 31 for providing a resiliently flexible support surface. The drawer member 33 is positionable within the outer housing 31 and accessible through the open end. The drawer member 33 is designed for receiving user accessories 8, such as pens, pencils, erasers, paper clips, and the like.

In still a further embodiment the second wrist support member 40 further comprises a second outer housing 41 a second cushion portion 42, and a second drawer member 43, similar to the wrist support member 30. The second outer housing 41 is designed for supporting a wrist of a user writing in the notebook 2, and may be substantially hollow with an open end. The second cushion portion 42 is operationally coupled to an exterior of the second outer housing 41 for providing a resiliently flexible support surface. The second drawer member 43 is positionable within the second outer housing 41 and accessible through the second open end. The second drawer member 41 is also designed for receiving user accessories 8.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A notebook cover assembly comprising:

a cover member having a first portion and a second portion, said first portion being pivotally coupled to said second portion, said cover member being adapted for receiving a notebook; and a wrist support member operationally coupled to said cover member, said wrist support member providing support for a wrist of a user writing on the notebook;

wherein said cover member further comprises a first sleeve member coupled to said first portion of said cover member, said first sleeve member and said first portion of said cover member forming a pocket for selectively receiving a cover of a notebook whereby the notebook is retained in said notebook cover assembly.

2. The assembly of claim 1, wherein said wrist support member being positioned below said pocket whereby said wrist support member abuts a bottom edge of the notebook retained by said pocket.

3. The assembly of claim 2, wherein said cover member further comprises a second sleeve member coupled to said second portion of said cover member, said second sleeve member and said second portion of said cover member forming a second pocket for selectively receiving a second cover of the notebook whereby the notebook is retained in said notebook cover assembly.

4. The assembly of claim 2, further comprising a second wrist support member operationally coupled to said cover member, said wrist support member providing support for a wrist of a user writing on the notebook.

5. The assembly of claim 4, wherein said second wrist support member is operationally coupled to said second portion of said second cover member.

6. The assembly of claim 4, further comprising:

a second sleeve member coupled to said second portion of said cover member, said second sleeve member and said second portion of said cover member forming a second pocket for selectively receiving a second cover of the notebook whereby the notebook is retained in said notebook cover assembly;

a second wrist support member being positioned below said second pocket whereby said wrist support member abuts a bottom edge of the notebook retained by said second pocket.

7. A notebook cover assembly comprising:

a cover member having a first portion and a second portion, said first portion being pivotally coupled to said second portion, said cover member being adapted for receiving a notebook, said cover member further comprises a first sleeve member coupled to said first portion of said cover member, said first sleeve member and said first portion of said cover member forming a pocket for selectively receiving a cover of a notebook whereby the notebook is retained in said notebook cover assembly, said cover member further comprises a second sleeve member coupled to said second portion of said cover member, said second sleeve member and said second portion of said cover member forming a second pocket for selectively receiving a second cover of the notebook whereby the notebook is retained in said notebook cover assembly;

a wrist support member operationally coupled to said cover member, said wrist support member providing support for a wrist of a user writing on the notebook, said wrist support member being positioned below said pocket whereby said wrist support member abuts a bottom edge of the notebook retained by said pocket; and a second wrist support member operationally coupled to said cover member, said wrist support member providing support for a wrist of a user writing on the notebook, said second wrist support member being positioned below said second pocket whereby said wrist support member abuts a bottom edge of the notebook retained by said second pocket.

8. The notebook cover assembly of claim 7, wherein said wrist support member further comprises:

an outer housing adapted for supporting a wrist of a user writing in the notebook, said outer housing being substantially hollow, said outer housing having an open end;

a drawer member positionable within said outer housing and accessible through said open end, said drawer member being adapted for receiving user accessories.

9. The notebook cover assembly of claim 7 wherein said wrist support member further comprises a cushion portion for providing resiliently flexible support surface.

10. The assembly of claim 7 wherein said wrist support member further comprises:

an outer housing adapted for supporting a wrist of a user writing in the notebook, said outer housing being substantially hollow, said outer housing having an open end;

a cushion portion operationally coupled to an exterior of said outer housing for providing resiliently flexible support surface;

a drawer member positionable within said outer housing and accessible through said open end, said drawer member being adapted for receiving user accessories.

11. The notebook cover assembly of claim 7, wherein said second wrist support member further comprises:

a second outer housing adapted for supporting a wrist of a user writing in the notebook, said second outer housing being substantially hollow, said second outer housing having an second open end;

a second drawer member positionable within said second outer housing and accessible through said second open end, said second drawer member being adapted for receiving user accessories.

12. The notebook cover assembly of claim 7 wherein said second wrist support member further comprises a second cushion portion for providing resiliently flexible support surface.

13. The assembly of claim 7, wherein said second wrist support member further comprises:

a second outer housing adapted for supporting a wrist of a user writing in the notebook, said second outer housing being substantially hollow, said second outer housing having an open end;

a second cushion portion operationally coupled to an exterior of said second outer housing for providing resiliently flexible support surface;

a second drawer member positionable within said second outer housing and accessible through said second open end, said second drawer member being adapted for receiving user accessories.

14. The assembly of claim 7, further comprising:

wherein said wrist support member further comprises:

an outer housing adapted for supporting a wrist of a user writing in the notebook, said outer housing being substantially hollow, said outer housing having an open end;

a cushion portion operationally coupled to an exterior of said outer housing for providing resiliently flexible support surface;

a drawer member positionable within said outer housing and accessible through said open end, said drawer member being adapted for receiving user accessories;

wherein said second wrist support member further comprises:

a second outer housing adapted for supporting a wrist of a user writing in the notebook, said second outer housing being substantially hollow, said second outer housing having an open end;

a second cushion portion operationally coupled to an exterior of said second outer housing for providing resiliently flexible support surface; and a second drawer member positionable within said second outer housing and accessible through said second open end, said second drawer member being adapted for receiving user accessories.

15. A notebook cover assembly comprising:

a cover member having a first portion and a second portion, said first portion being pivotally coupled to said second portion, said cover member being adapted for receiving at least one notebook, said cover member further comprises a first sleeve member coupled to said first portion of said cover member, said first sleeve member and said first portion of said cover member forming a pocket for selectively receiving a cover of the at least one notebook whereby the notebook is retained in said notebook cover assembly, said cover member further comprises a second sleeve member coupled to said second portion of said cover member, said second sleeve member and said second portion of said cover member forming a second pocket for selectively receiving a second cover of the at least one notebook whereby the notebook is retained in said notebook cover assembly;

a wrist support member operationally coupled to said cover member, said wrist support member providing support for a wrist of a user writing on the notebook, said wrist support member being positioned below said pocket whereby said wrist support member abuts a bottom edge of the notebook retained by said pocket; and a second wrist support member operationally coupled to said cover member, said wrist support member providing support for a wrist of a user writing on the notebook, said second wrist support member being positioned below said second pocket whereby said wrist support member abuts a bottom edge of the notebook retained by said second pocket.

16. The assembly of claim 15, further comprising:

wherein said wrist support member further comprises:

an outer housing adapted for supporting a wrist of a user writing in the notebook, said outer housing being substantially hollow, said outer housing having an open end;

a cushion portion operationally coupled to an exterior of said outer housing for providing resiliently flexible support surface;

a drawer member positionable within said outer housing and accessible through said open end, said drawer member being adapted for receiving user accessories;

wherein said second wrist support member further comprises:

a second outer housing adapted for supporting a wrist of a user writing in the notebook, said second outer housing being substantially hollow, said second outer housing having an open end;

a second cushion portion operationally coupled to an exterior of said second outer housing for providing resiliently flexible support surface; and a second drawer member positionable within said second outer housing and accessible through said second open end, said second drawer member being adapted for receiving user accessories.

* * * * *